United States Patent [19]

Bain et al.

[11] Patent Number: 4,462,735

[45] Date of Patent: Jul. 31, 1984

[54] NEWSPAPER LIVE STORAGE BUFFER

[75] Inventors: Lawrence J. Bain, LaGrange, Ill.; Robert D. Eckerson, Merrimac; Paul D. Siniscal, Hollis, both of N.H.

[73] Assignee: Rockwell International Corporation, Pittsburgh, Pa.

[21] Appl. No.: 382,539

[22] Filed: May 27, 1982

[51] Int. Cl.[3] ..... B65G 57/14

[52] U.S. Cl. ..... 414/37; 414/47; 414/102; 198/472

[58] Field of Search ..... 414/47, 102, 37, 564, 414/285; 198/472, 648, 796, 747, 736, 746, 738, 721, 719, 717

[56] References Cited

U.S. PATENT DOCUMENTS

| | | | |
|---|---|---|---|
| 3,131,819 | 5/1964 | Ducayet | 414/47 |
| 3,448,870 | 6/1969 | Gallo et al. | 414/564 X |
| 3,498,478 | 3/1970 | Eliassen | 414/564 |
| 3,989,094 | 11/1976 | Gorenflo et al. | 198/736 X |

*Primary Examiner*—Robert J. Spar
*Assistant Examiner*—Jonathan D. Holmes

[57] ABSTRACT

A live storage buffer for receiving newspapers from a printing press which includes an endless conveyor having carriers adapted to travel about the pathway of the conveyor and to removably support newspaper container members thereon. A pair of spaced transfer conveyors operatively associated with the endless conveyor are adapted to sequentially receive and then return the containers to the endless conveyor. On one transfer conveyor the containers are positioned by an indexing member at a location for receiving a supply of newspapers, and on the other transfer conveyor the containers are indexed to a position where the newspapers are unloaded for further processing downstream of the storage buffer.

3 Claims, 12 Drawing Figures

FIG. 10
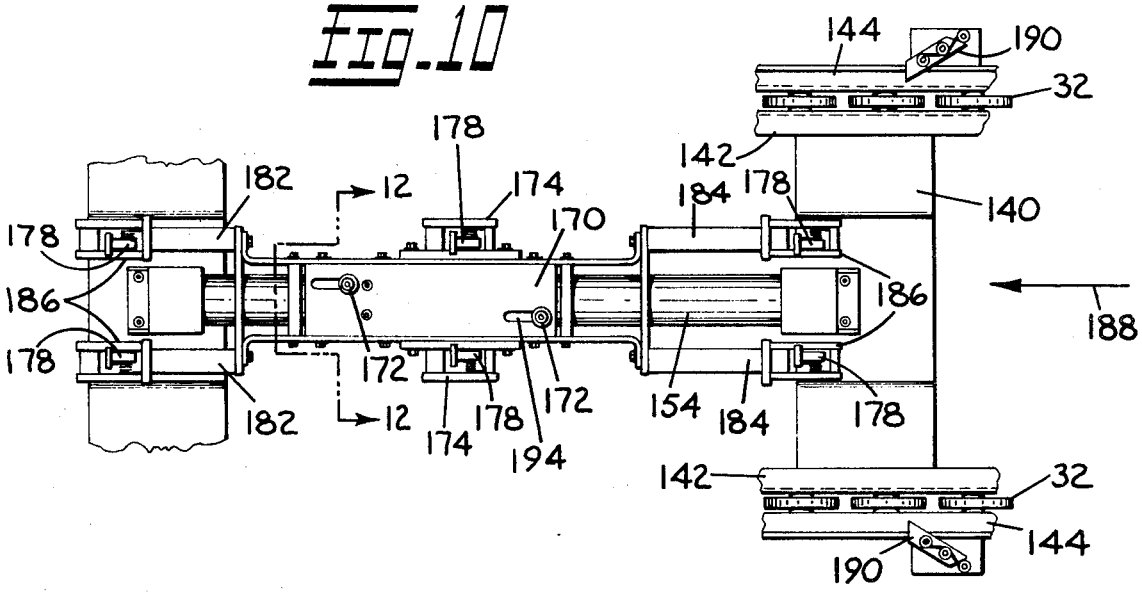
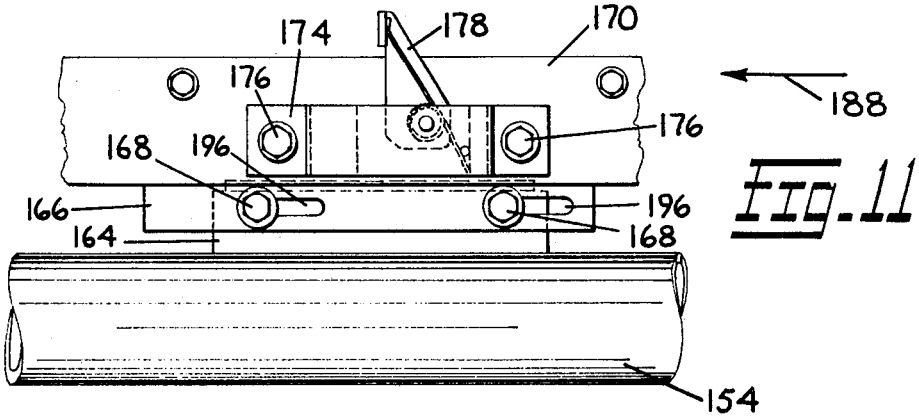
FIG. 11
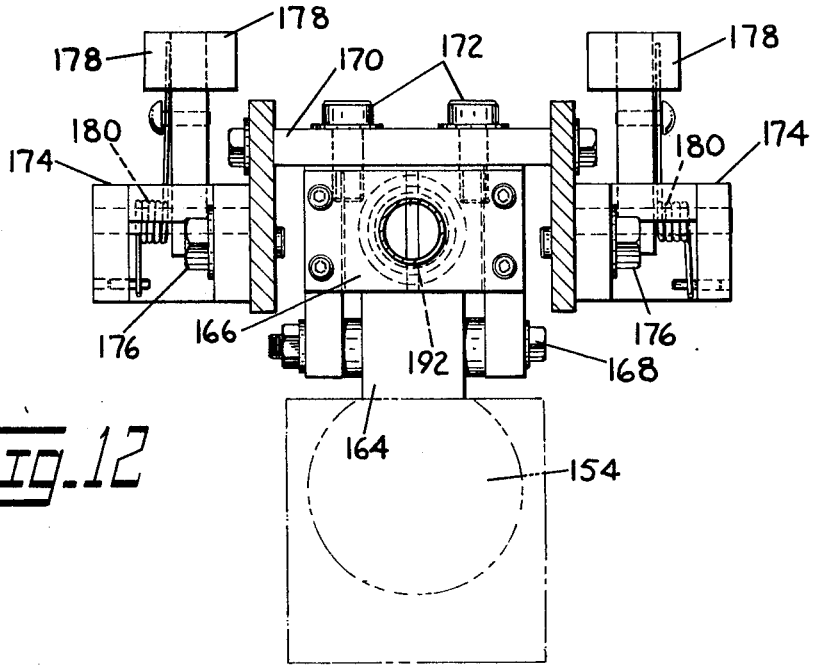
FIG. 12

NEWSPAPER LIVE STORAGE BUFFER

BACKGROUND OF THE INVENTION

The newspaper live storage buffer according to the invention pertains to a completely automatic system for handling newspapers as they leave the printing press whereby a reserve supply of newspapers is maintained that is capable of compensating for unintentional shutdown of the press as well as other devices downstream of the storage buffer which effect further processing of said newspapers.

U.S. Pat. No. 3,881,716 discloses an apparatus for handling newspapers which includes an accumulator for receiving newspapers from the press and storing them in static form in the event the stuffers or other downstream devices should stop and interrupt the flow of newspapers that normally bypass the accumulator.

The storage buffer comprising the invention is considered a definite advance in the art, for the newspapers, as they leave the press, are directed into and through said storage buffer whereby they are processed in the order that they were printed.

SUMMARY OF THE INVENTION

The newspaper storage buffer according to the invention is adapted to receive newspapers being advanced along a stream conveyor from a printing press and includes an endless conveyor having a plurality of carrier elements mounted thereon for travel about the conveyor's pathway. These carriers are adapted to support newspaper container members which by means of a pair of spaced transfer conveyors operatively associated with the endless conveyor, said containers are adapted to be sequentially received from and returned to the endless conveyor. While with one transfer conveyor the containers are indexed to a position where they are loaded with a pre-selected number of newspapers and when with the other transfer conveyor they are indexed to a position for unloading the newspapers. After the containers are unloaded they are returned to the endless conveyor to repeat the cycle and the unloaded newspapers positioned for advance by another conveyor for further processing.

It is a general object of the invention to provide a live storage buffer for newspapers which will permit a continued flow of newspapers through the entire processing system in the event of unintentional press interruption, or will continue to accept papers from the press should other devices downstream of said storage buffer be interrupted.

Other objects and advantages of the invention will become more fully apparent by reference to the appended claims and as the following detailed description proceeds in reference to the figures of drawing wherein:

BRIEF DESCRIPTION OF THE DRAWINGS

FIG. 10 is a top view of a pneumatic cylinder for effecting movement of the containers along that portion of the transport conveyor shown in FIG. 8;

FIG. 11 is a view in side elevation of a portion of the pneumatic cylinder shown in FIG. 8; and FIG. 12 is a sectional view as seen looking in the direction of the indicating arrows 12—12 in FIG. 10.

DESCRIPTION OF THE PREFERRED EMBODIMENT

Figure 1:
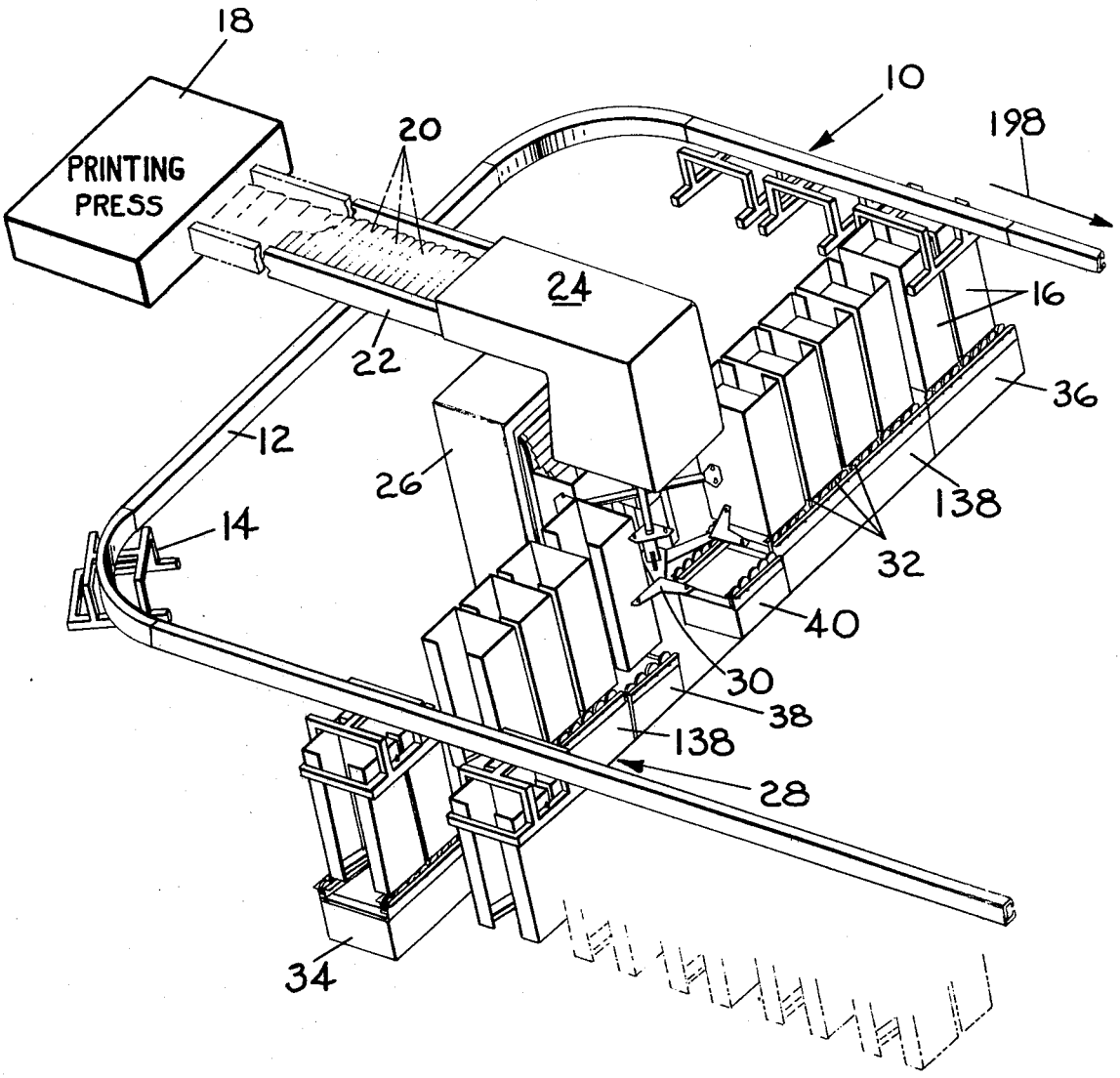
FIG. 1 is a perspective view of the storage buffer according to the invention showing the section having a transport conveyor for directing containers to and from a position for receiving newspapers therein.
Figure 2:
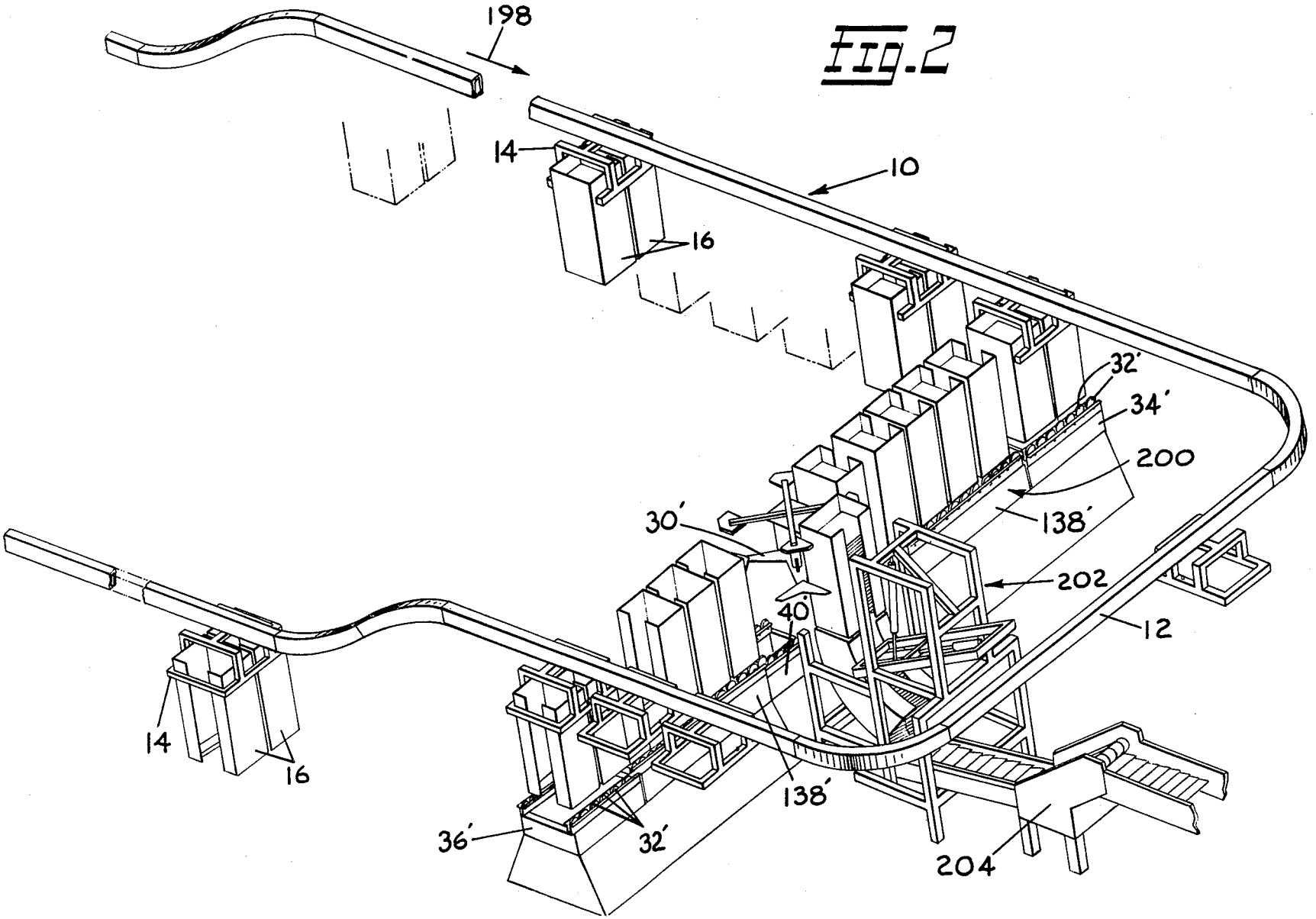
FIG. 2 is a perspective view of that portion of the storage buffer not shown in FIG. 1 including a transport conveyor for directing loaded containers to and from a position to effect removal of the newspapers therefrom.

Referring now to FIGS. 1 and 2, the newspaper live storage buffer comprising the invention is identified generally by numeral 10 and includes an endless conveyor 12.

This endless conveyor 12 has a plurality of carrier elements 14 depending therefrom which are operatively connected to a driven chain (not shown) for effecting travel of said carrier elements about the entire pathway formed by said conveyor.

As shown in FIGS. 1 and 2 each carrier element 14 is capable of supporting a pair of container members 16 that are sequentially presented to a newspaper loader and then an unloader in a manner to be more fully described hereinafter.

With reference to FIG. 1 the printing press is identified schematically by numeral 18 and the newspapers 20 emanating therefrom are caused to travel in shingled relation along a stream conveyor 22. From the conveyor 22 the newspapers enter a loader receiving member 24 which is operatively connected to a newspaper loader 26 that is effective in loading pre-selected numbers of newspapers into the container members 16.

As shown in FIG. 1 the container members 16 are transferred to a transfer conveyor that is identified generally numeral 28.

An indexing member in the form of a rotor or carousel 30 is disposed intermediate the ends of the transfer conveyor 28 and in operative association with the newspaper loader 26. The transfer conveyor 28 is provided with a plurality of rollers 32 which are adapted to engage the underside of the containers to effect their advance toward and from the carousel 30.

The container entrance and exit ends of the transfer conveyor 28 are provided with elevator platforms or units 34 and 36 respectively which are adapted to accommodate a pair of containers 16 simultaneously and will be described in greater detail hereinafter. Immediately adjacent to and on each side of the carousel 30 the transfer conveyor 28 is provided with elevator platforms or units 38 and 40. These elevator units 38 and 40 are adapted to accommodate single containers 16 and respectively they are effective in placing a container onto the carousel 30 and then removing the same therefrom. Elevator units 38 and 40 are fabricated from the same components and perform like functions and for purpose of brevity only elevator unit 38 shown in FIGS. 3 and 4 will be described in detail. This elevator unit 38 includes a plurality of rollers 32 for engaging the underside of a coantainer 16. A base 42 forms the lower portion of the elevator unit 38 and is interconnected with the upper end having the rollers 32 by means of a pair of scissor actuating members generally identified by numeral 44. These scissor actuating members are formed by a pair of elongated levers 46 and 48 which are interconnected intermediate their ends for pivotal movement by means of a bolt 50. The upper ends of levers 46 are pivotably connected to upper side rails 51 of the elevator unit 38 by means of pins 52 and the lower ends have rollers 54 assembled thereon. These rollers 54 are confined for movement within a raceway formed by the combination of an angle bracket 56 and a block 58 mounted on each side of the base portion 42.

Figure 4:
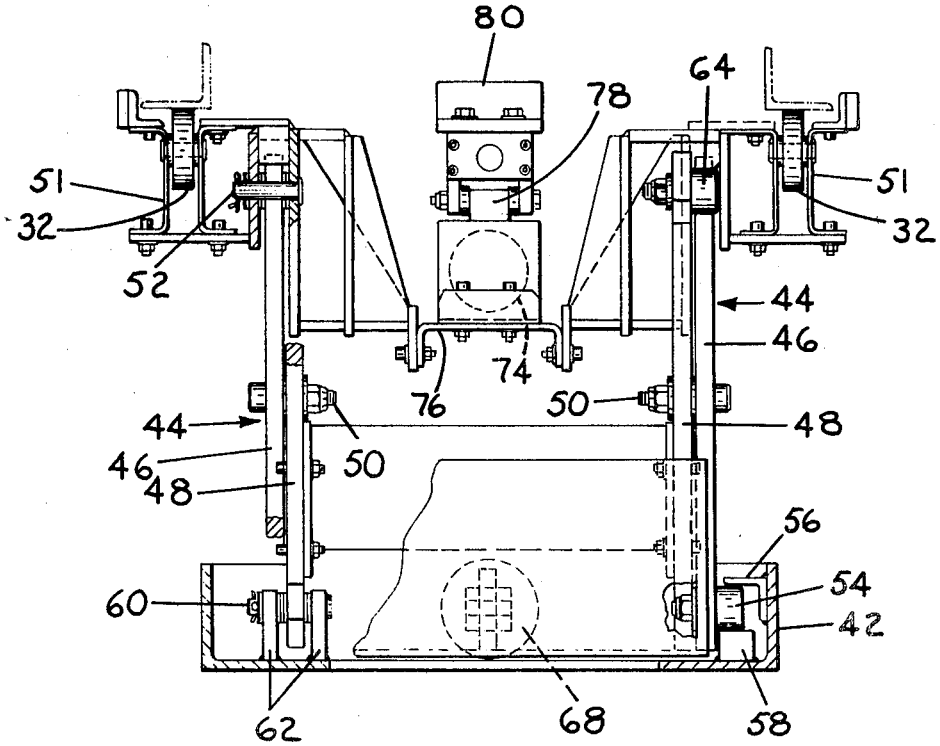
FIG. 4 is an end view of the elevator platform shown in FIG. 3.

As shown in FIG. 4 the lower end of lever 48 is pivotably attached by means of a pin 60 to a pair of spaced lugs 62 fixed to the base portion 4. The upper ends of the levers 48 have a roller 64 assembled thereon which is adapted to engage a raceway identified by numeral 66. The scissor activating members 44 are caused to raise and lower the upper container supporting portion of the elevator unit 38 by means of a tandem type pneumatic cylinder 68 which is pivotably mounted within the base 42 as at 70 and which include piston rods 72 and 73 that are operatively connected to the lower ends of the elongated levers 46 and 48 respectively.

Figure 3:
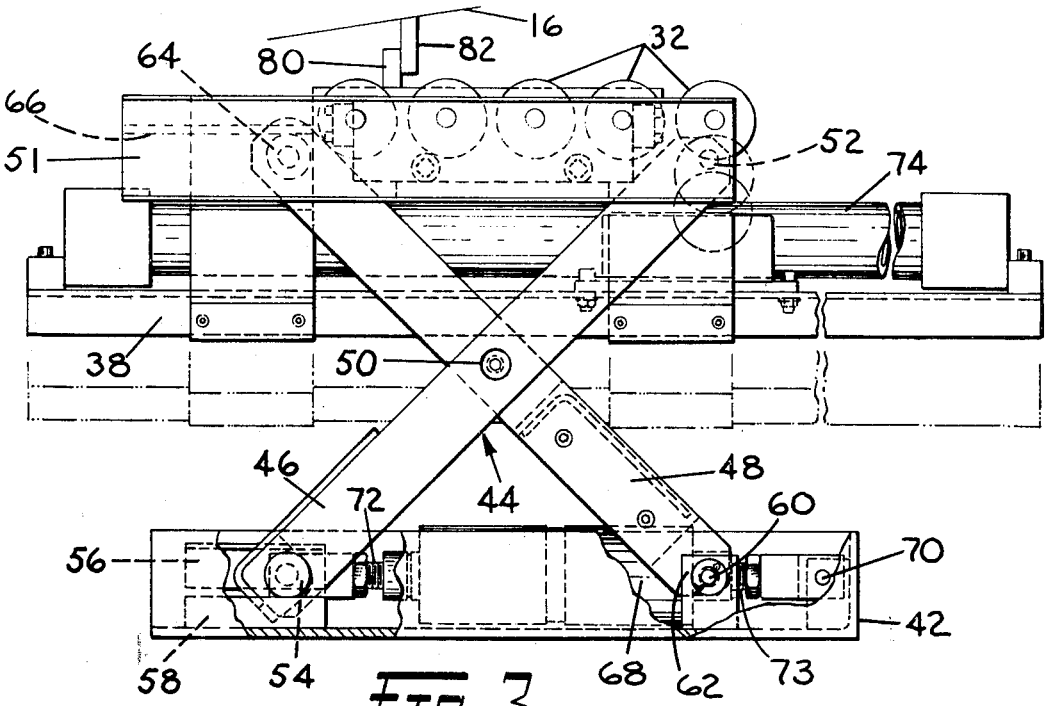
FIG. 3 is a view in side elevation of a portion of the transport conveyor defining an elevator platform for locating containers in a position for delivery to and from positions of loading and unloading newspapers therefrom.

A pneumatic cylinder 74 of the rodless type is mounted on a support structure 76 (FIG. 4) disposed intermediate the rollers 32 and side rails 51 and is adapted to be raised and lowered with the latter as required. This pneumatic cylinder 74 includes an actuating member 78 which is caused to reciprocate in a pathway parallel to the axis of said cylinder. An upwardly directed lip element 80 is assembled on and for movement with the actuating member 78 and is adapted to engage a depending lip 82 provided on the underside of the containers 16 (FIG. 3). Such engagement is effective in causing the pneumatic cylinder 74 to move a container along rollers 32 as required toward and away from the carousel 30. Additionally the tandem type pneumatic cylinders 68 are effective in raising and lowering the rollers 32 so as to present or disengage a container from the carousel 30. Elevator units 34 and 36 are fabricated from the same components and perform the same function and for purpose of brevity only elevator unit 34 shown in FIGS. 5, 6 and 7 will be described in detail.

Figure 5:
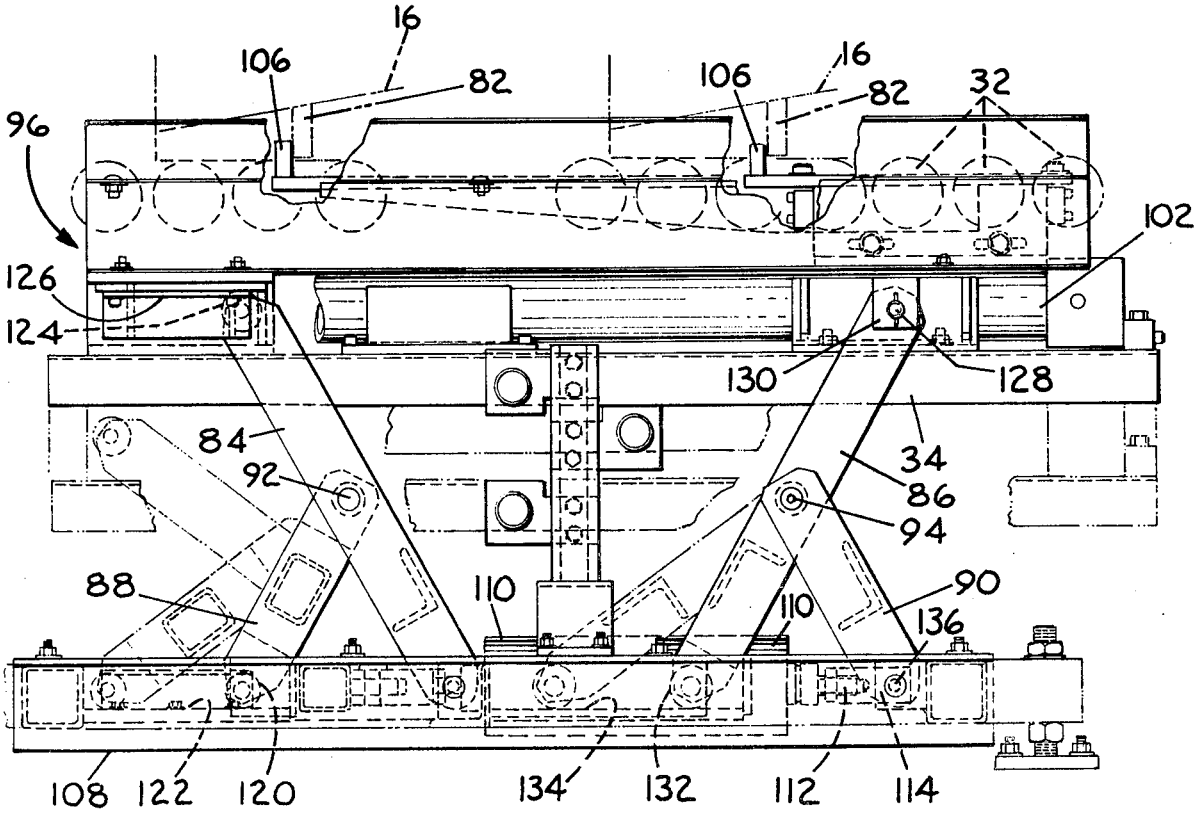
FIG. 5 is a view similar to FIG. 3 but showing an elevator platform defining the outer opposed ends of the transport conveyors.
Figure 6:
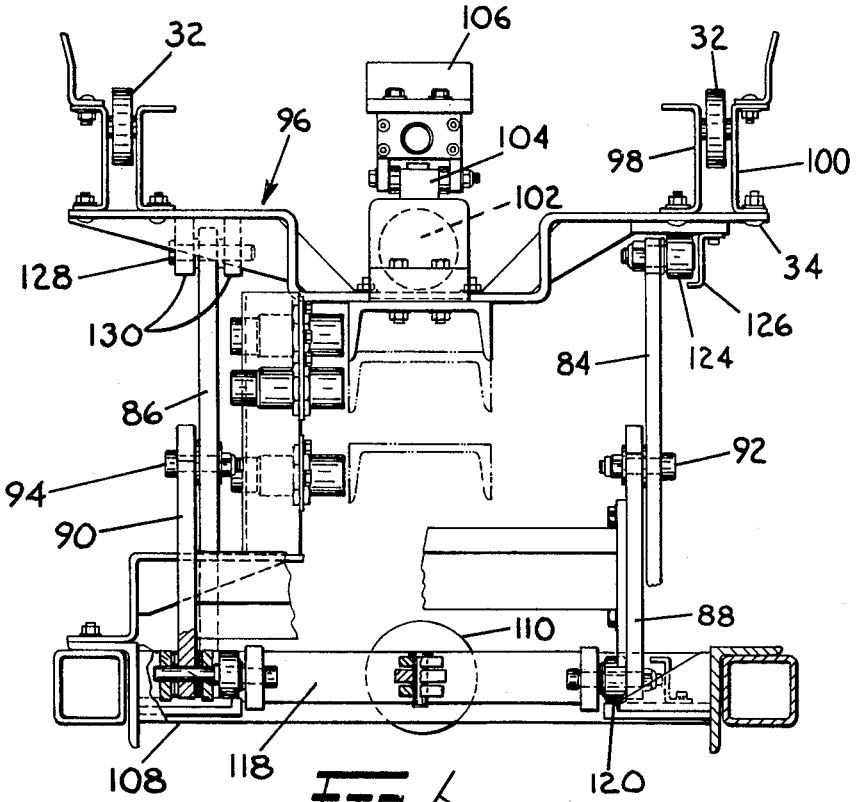
FIG. 6 is an end view of the elevator platform shown in FIG. 5.
Figure 7:
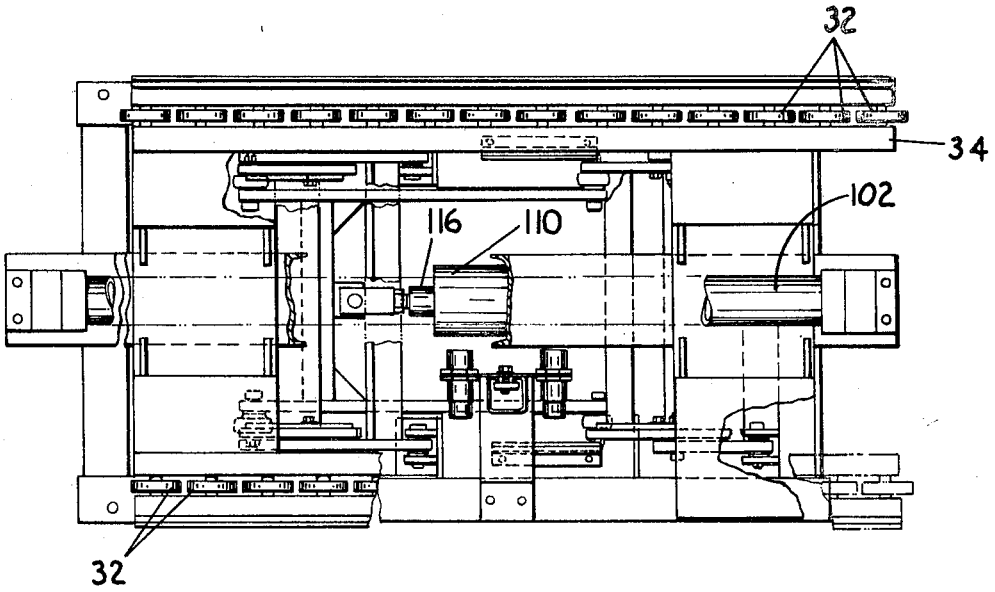
FIG. 7 is a top view of the elevator platform shown in FIGS. 5 and 6.

As shown in FIG. 5 elevator unit 34 is similar to elevator unit 38 shown in FIG. 3, but is of greater length so that it can accommodate two containers 16 simultaneously. The length of elevator unit 34 necessitates a greater number of rollers 32 and in place of elongated levers 46 and 48 this unit utilizes a pair of spaced lifting levers 84 and 86 with shorter cooperating levers 88 and 90 respectively pivotably connected at one end to said lifting levers as at 92 and 94 respectively. The upper portion of the elevator unit 34 defines a platform identified generally by numeral 96 (FIG. 6) which is adapted to support the rollers 32 between opposed rail elements 98 and 100. Additionally this platform 96 supports a pneumatic cylinder 102 of the rodless type which includes an activating member 104 (FIG. 6) that is caused to reciprocate in a pathway parallel with the axis of said cylinder. The base of the elevator unit 34 is identified generally by numeral 108 and like elevator unit 38 has pneumatic cylinders 110 of the tandem type assembled therein. The actuating rod identified by numeral 112 (FIG. 5) of these pneumatic cylinders 110 is connected to a lug on a stationary transverse bar 114, part of the base 108 through a clevis and pin. The lower ends of the cooperating levers 90 are also pivotally attached to the tube 114 through a pair of spaced lugs. The other actuating rod of the pneumatic cylinders 110 is depicted by numeral 116 (FIG. 7) and is pivotally attached to a transverse bar 118 (FIG. 7). One set of ends of the transverse bar 118 is operatively associated with the lower ends of the cooperating levers 88 which are provided with rollers 120 which are movable within the limits of raceways 122 to effect movement of said levers 88 between the solid and phantom line positions shown in FIG. 5. This movement of levers 88 will cause rollers 124 on the upper ends of the lifting levers 84 to travel within the limits of raceways 126 causing the lifting levers 84 to move between the solid and phantom line positions shown in FIG. 5. Movement of levers 84 and 88 in the manner described supra causes a simultaneous similar movement of levers 86 and 90, yet to be described, the combination of which effect the raising and lowering of the platform 96 as desired. Referring again to FIG. 5, the upper ends of the lifting levers 86 are pivotably attached to the underside of the platform 96 by means of pins 128 supported in a pair of spaced depending lugs 130. The lower ends of the lifting levers 86 have rollers 132 assembled thereon and are movable within the limits of raceways 134. The cooperating lever 90 which has one end pivotably connected to the lifting lever 86, has its opposite end pivotably attached in a fixed position within the base 108 as at 136.

Figure 8:
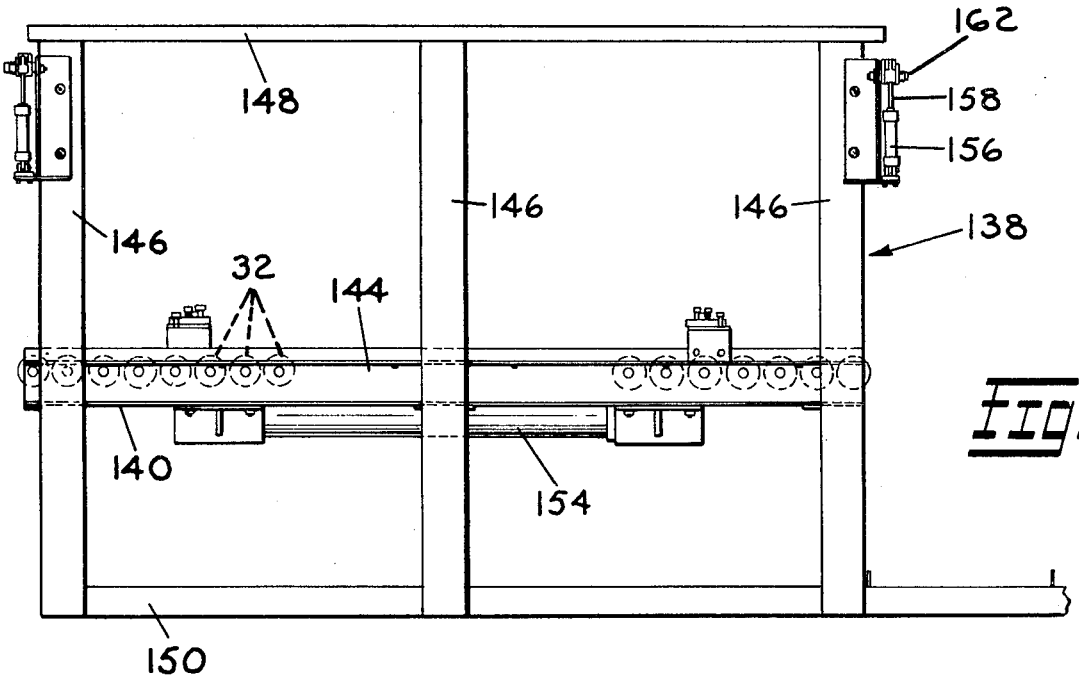
FIG. 8 is a view in side elevation of that portion of the transport conveyors disposed intermediate the elevator platforms.
Figure 9:
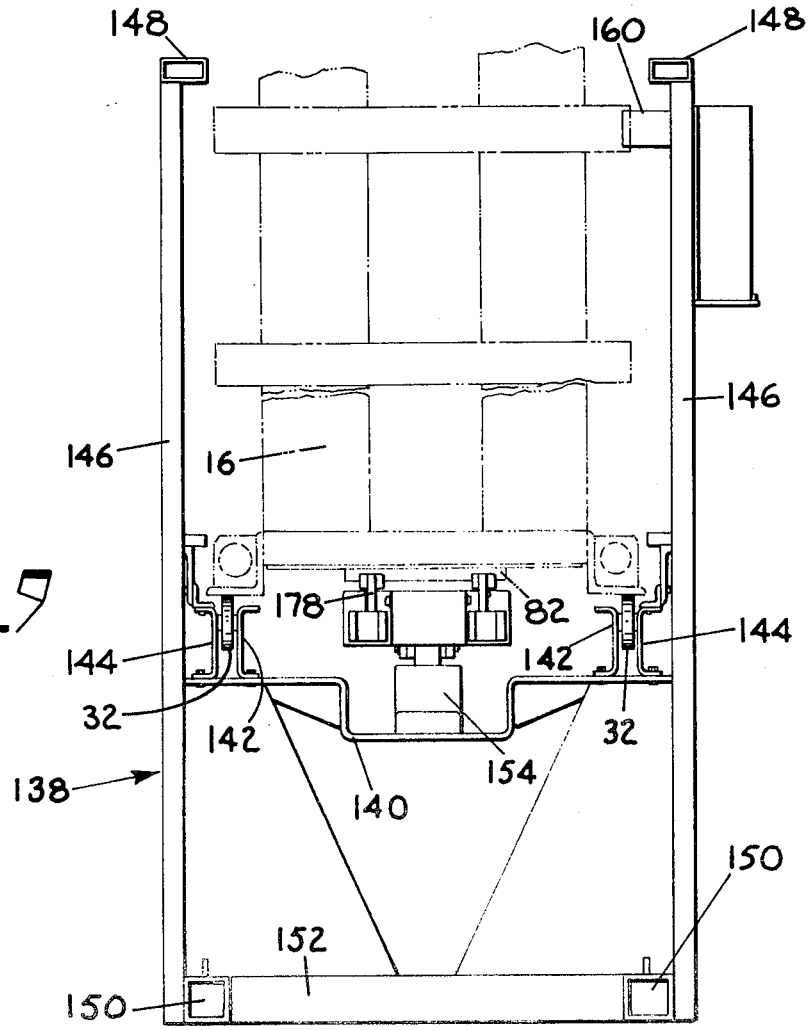
FIG. 9 is an end view of the transport conveyor shown in FIG. 8.

Referring now to FIGS. 8 and 9 numeral 138 depicts generally those portions of the transfer conveyor 28 located intermediate the elevator units 34 and 38, and 36 and 40, respectively. These intermediate conveyor portions 138 include a stationary platform 140 which like platform 96 (FIG. 6) is adapted to support rollers 32 between opposed rail elements 142 and 144. The stationary platform 140 is horizontally supported in a framework comprising a plurality of spaced and vertically extending side members 146 which are interconnected by upper and lower longitudinally extending tubular members 148 and 150 respectively. As shown in FIG. 9 the lower end of the framework is interconnected by a transverse element 152 (one only shown). Also shown in FIG. 9 is the lower end of a container 16 and the manner in which it is caused to engage the rollers 32. To advance the container along the rollers 32 that are associated with the stationary platform 140 of this portion of the transfer conveyor 28, a pneumatic cylinder 154 of the rodless type is utilized and will be more fully described hereinafter by reference to FIGS. 10, 11 and 12.

The containers 16 are removed from and returned to the endless conveyor 12 in pairs and while on the transfer conveyor 28 are individually presented to the loader 26 where they receive a load of superposed newspapers therein. To control the advance of the containers along the rollers 32 associated with the stationary platform 140, a pneumatic cylinder 156 is mounted adjacent the upper end of one of the vertically extending side member 146 (FIG. 8). This pneumatic cylinder 156 is vertically disposed and its actuating rod 158 is connected to an arm 160 (FIG. 9) which is pivotably mounted as at 162 to the upper end of a side member 146. Actuation of the pneumatic cylinder 156 is effective in pivoting the arm 160 to and from the pathway which the containers are caused to travel on rollers 32. In FIG. 9 the arm 160 is shown in a horizontal position whereat it will be engaged by a container 16 to temporarily hold up advance of the latter.

The pneumatic cylinder shown in FIGS. 10, 11 and 12 has an actuating member identified by numeral 164 with a frame support 166 assembled thereto by means of bolts 168. A pusher frame 170 is assembled on the upper surface of the frame support 166 by means of shoulder screws 172. As shown in FIGS. 10 and 12 each side of the pusher frame 170 has a housing block 174 assembled thereon by means of cap screws 176. These housing blocks 174 are adapted to pivotable support upwardly extending pusher levers 178 which are biased in a clockwise direction as viewed in FIG. 11 by a torsion type spring 180.

As shown in FIG. 10, each end of the pusher frame 170 is provided with a pair of pusher extensions with those shown on the left being depicted by numeral 182 and those on the right by numeral 184. The free ends of each of these pusher extentions have a housing block 186 fixed thereon and like housing blocks 174 they each pivotably support upwardly extending spring biased pusher levers 178. The pusher levers in housing blocks 186 are in longitudinal alignment with those in housing blocks 174 and when caused to move with the actuating member 164 in the direction of the indicating arrows 188 in FIGS. 10 and 11, the upper ends of said pusher levers are adapted to engage the depending lips 82 on the underside of the containers and advance the latter along the rollers 32.

To prevent any movement of the containers in a direction opposite to their advance by the pusher levers 178, the rail elements 144 as shown in FIG. 10 are each provided with a spring biased back stop lever 190. These backstop levers 190 are depressed outwardly as the containers travel thereby and after clearing each container they immediately return to the position shown in FIG. 10 to prevent any possible reverse movement of a container. Return movement of the actuating member 164 to its initial position causes the pusher frame 170 and its pusher-levers 178 to move therewith. As the pusher-levers are moved in this manner they are pivoted in a counter-clockwise direction as they engage the depending lips of other containers 16 during their movement to their initial location whereat they are in readiness to repeat the cycle.

With reference to FIG. 12, the operating connection between the actuating member 164 and the pusher frame 170 includes a cushioning as shock absorbing device that defines a compression spring 192 assembled within said frame support 166. The shoulder screws 172 which attach the pusher frame 170 to the frame support 166 pass through slots 194 (FIG. 10) in said pusher frame and allow the later independent movement within the limits of said slots during movement of the actuating member 164 in the direction of the indicating arrow 188. This arrangement also permits bolts 168 (FIG. 11) to move within the limits of slots 196 through which they extend to attach the frame support 166 to the actuating member 164.

The containers 16 after being loaded with newspapers 20 leave the transfer conveyor 28 by means of the elevator unit 36 which is effective in returning two containers simultaneously onto a carrier element 14. The carrier elements 14 after receiving the containers 16 from the elevator unit are caused to travel along the endless conveyor 12 in the direction of the indicating arrow 198 shown in FIGS. 1 and 2. Travel of the loaded containers in this direction is interrupted when they arrive at another transfer conveyor that is identified generally in FIG. 2 by numeral 200.

This transfer conveyor 200 is structurally the same as the transfer conveyor 28 and as it performs a like function, the various elements and devices thereof will be given identification numerals corresponding to those of said conveyor 28 but with the addition of primes.

The rotor or carousel depicted by numeral 30' located intermediate the ends of the transfer conveyor 200 is effective in individual removal of each loaded container from said conveyor and then presenting it to an unloading apparatus identified generally by numeral 202 in FIG. 2. In this position the newspapers are removed from the containers 16 and presented to a newspaper stream forming device 204 (FIG. 2) of the type shown and described in co-pending application No. 303,319 filed Sept. 17, 1981.

After a container has been unloaded it is returned to the conveyor 200 and advanced to the elevator unit 36' which is effective in returning two containers simultaneously onto a carrier element 14 whereat they are in readiness to repeat the cycle of advancing to the transfer conveyor 28.

Although the present invention has been described in connection with a preferred embodiment it is to be understood that modifications and variations may be resorted to without departing from the spirit and scope of the invention as those skilled in the art will readily understand. Such modifications and variations are considered to be within the purview and scope of the invention and the appended claims.

We claim:

1. An apparatus for receiving an imbricated stream of newspapers from a printing press accumulating them in individual vertical stacks at a first transfer location and moving the stacks to a second transfer location where they are again formed into an imbricated stream, said apparatus comprising:

(a) an endless conveyor having longitudinal runs and lateral runs which connect the ends of the longitudinal runs, (b) a plurality of carrier elements dependent from said endless conveyors and moveable there around, (c) vertically elongated containers removably mounted on and dependent from said carrier elements during travel along the longitudinal runs of said endless conveyor to transport vertical stacks of newspapers from the one location to the second location, (d) linear conveyor means positioned lower than said endless conveyor and extending substantially parallel to the lateral runs of said endless conveyor adjacent both the first location and the second location to support and move said containers, each of said linear conveyor means being comprised of two sections having outer ends located beneath the longitudinal runs and inner ends separated from each other located between the longitudinal runs;

(e) rotary indexing means positioned between said inner ends of said linear conveyor means to move said containers in sequence from one of said inner ends to one of the newspaper transfer locations and then to the other of said inner ends; and (f) vertically moveable elevator means at the outer and inner ends of said linear conveyor means to mount and to demount said containers on and off, respectively, of said carrier elements and said rotary indexing means.

2. The structure according to claim 1 wherein said elevator means forming the inner ends of said linear conveyor means include:

(a) platforms to receive said containers;

(b) a base portion disposed below and in spaced alignment with said elevator platforms;

(c) scissor actuating members interconnecting said base position with said elevator platforms; and (d) a pneumatic cylinder operatively connected to said scissor actuating members for raising and lowering said elevator platforms as required.

3. The structure according to claim 2 wherein said linear conveyor means includes a rodless pneumatic cylinder operatively associated with each said elevator platforms for engaging the underside of said container members to effect their advance along said linear conveyor means.

* * * * *